US009162238B1

(12) United States Patent
Abeyta

(10) Patent No.: US 9,162,238 B1
(45) Date of Patent: Oct. 20, 2015

(54) OSCILLATING PRESSURIZED SPRAY TIP PROTECTION ASSEMBLY

(76) Inventor: Frank A. Abeyta, Brighton, CO (US)

( * ) Notice: Subject to any disclaimer, the term of this patent is extended or adjusted under 35 U.S.C. 154(b) by 735 days.

(21) Appl. No.: 13/342,272

(22) Filed: Jan. 3, 2012

(51) Int. Cl.
*B05B 1/28* (2006.01)

(52) U.S. Cl.
CPC ..... *B05B 1/28* (2013.01)

(58) Field of Classification Search
CPC ..... B05B 15/06; B05B 1/28; B05B 3/02; B05B 3/04
USPC ..... 239/288, 288.5, 203, 204, 451, 452
See application file for complete search history.

(56) References Cited

U.S. PATENT DOCUMENTS 5,037,030 A * 8/1991 Apodaca ..... 239/288
5,454,515 A 10/1995 Perret, Jr.
6,186,416 B1 * 2/2001 Jones ..... 239/288.5
6,488,218 B1 * 12/2002 Townsend et al. ..... 239/205
6,502,763 B1 1/2003 McCann
6,764,025 B1 * 7/2004 Espina ..... 239/288
6,981,721 B2 1/2006 Karasawa
D524,403 S 7/2006 Strandell
7,617,994 B2 * 11/2009 Gunderson et al. ..... 239/288.5
2005/0284956 A1 * 12/2005 Mast ..... 239/288
2007/0131792 A1 6/2007 Gardner et al.
2009/0065612 A1 3/2009 Gardner et al.
2010/0270402 A1 10/2010 Gilpatrick et al.
2012/0161433 A1 * 6/2012 Magargal et al. ..... 285/133.3

* cited by examiner

*Primary Examiner* — Davis Hwu

(57) ABSTRACT

The oscillating pressurized spray tip protection assembly is comprised of a tip guard and a lock plate that lock together via securing means over an oscillating spray tip in order to protect against wear when said spray tip is penetrating ground. The spray tip protection assembly utilizes a material that is strong, and more durable than the spray tip enclosed therein such that the life of the spray tip is increased. The tip guard has a cavity contoured to an exterior surface of the oscillating spray tip with an opening at a front end of the tip guard thereby enabling pressurized water to exit from both the oscillating spray tip as well as the tip guard.

7 Claims, 5 Drawing Sheets

OSCILLATING PRESSURIZED SPRAY TIP PROTECTION ASSEMBLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of pressure washing equipment, more specifically, pressure washer tips and means of preservation.

Pressure washers and oscillating spray tips used in connection therewith have been around for some time. More specifically, high-pressure water devices are sometimes used to locate buried utility lines by directing a jet of high-pressure water into the ground, which blasts the soil away. This process is sometimes referred to as "potholing." When using a pressure washer and an oscillating spray tip to detect utilities, the oscillating spray tips can wear down as they are repeatedly impacting hard surfaces and rock located underground. Oscillating spray tips are made of brass and can range from $50 to $80, and can wear down after a couple of weeks of use in "potholing." That being said, use of the oscillating spray tips becomes an expensive cost in conducting "potholing" operations. What is needed is a means of prolonging the lifetime of these spray tips.

The device of the application at bar seeks to overcome the shortfalls of oscillating spray tips used in "potholing". A tip protection assembly is uniquely contoured to protect the oscillating spray tips in order to prolong the life thereof.

B. Discussion of the Prior Art

As will be discussed immediately below, no prior art discloses a tip protection assembly for use with an oscillating spray tip, which is comprised of a tip guard and a lock plate that are secured together via securing means; wherein the tip guard is constructed of a material that is more durable than the oscillating spray tip material, and which protects the oscillating spray tip from wear and tear in connection with use as a means of "potholing"; wherein the tip protection assembly when installed upon an oscillating spray tip encases the oscillating spray tip therein so as to prevent unwanted disassembly and exposure.

The Gardner et al. Patent Application Publication (U.S. Pub. No. 2007/0131792) discloses a spray nozzle shroud for a pressure washer tip. However, the spray nozzle shroud is not a tip protection assemblage that is installed and encloses an oscillating spray tip in order to protect said tip from wearing down when potholing.

The Karasawa Patent (U.S. Pat. No. 6,981,721) discloses a coupling for high pressure fluid having a washer that is designed to extend the life of the joint. However, the coupling is not directed to protection of an oscillating spray tip that is used to penetrate the ground in order to detect utilities located thereunder.

The Perret Patent (U.S. Pat. No. 5,454,515) discloses a spray tip for a flat orifice tube that utilizes a rotatable turret member. However, the spray tip for a flat origice tip is not a protection assemblage that preserves the life of an oscillating spray tip when used to penetrate the ground in order to detect utilities.

The McCann Patent (U.S. Pat. No. 6,502,763) discloses a removable reversible spray tip member for use with a variety of airless spray systems. However, the spray tip member is not a spray tip protection assembly that encases an oscillating spray tip in order to protect and prolong the useable life of said spray tip when used to penetrate the ground.

The Gilpatrick et al. Patent Application Publication (U.S. Pub. No. 2010/0270402) discloses an assembly for controlling water turbulence through a high pressure cleaning machine that includes a nozzle body, which has an inlet, an outlet, and a flow path. However, the assembly is not specifically suited for prolonging the useful life of a brass oscillating spray tip that is used to penetrate the ground to detect items thereunder.

The Gardner et al. Patent Application Publication (U.S. Pub. No. 2009/0065612) discloses an adjustable nozzle for a pressure washer. However, the adjustable nozzle is not a spray tip protection assembly that inhibits wear of said spray tip when used to pentrate ground for detecting objects thereunder.

The Strandell Patent (U.S. Pat. No. Des. 524,403) illustrates an ornamental design for a nozzle tip for a pressure washer. Again, the design is not an assembly designed to protect a spray tip from wear when used to penetrate the ground in search of objects thereunder.

While the above-described devices fulfill their respective and particular objects and requirements, they do not describe a tip protection assembly for use with an oscillating spray tip, which is comprised of a tip guard and a lock plate that are secured together via securing means; wherein the tip guard is constructed of a material that is more durable than the oscillating spray tip material, and which protects the oscillating spray tip from wear and tear in connection with use as a means of "potholing"; wherein the tip protection assembly when installed upon an oscillating spray tip encases the oscillating spray tip therein so as to prevent unwanted disassembly and exposure. In this regard, the greeting card display frame departs from the conventional concepts and designs of the prior art.

SUMMARY OF THE INVENTION

The oscillating pressurized spray tip protection assembly is comprised of a tip guard and a lock plate that lock together via securing means over an oscillating spray tip in order to protect against wear when said spray tip is penetrating ground. The spray tip protection assembly utilizes a material that is strong, and more durable than the spray tip enclosed therein such that the life of the spray tip is increased. The tip guard has a cavity contoured to an exterior surface of the oscillating spray tip with an opening at a front end of the tip guard thereby enabling pressurized water to exit from both the oscillating spray tip as well as the tip guard.

It is an object of the invention to provide a spray tip protection assembly that encases an oscillating spray tip in order to prolong the useful life of the spray tip from wear associated with penetrating ground via a stream of pressurized water.

A further object of the invention is to provide a combination of a tip guard and a lock plate that secure together via securing means to encapsulate the oscillating spray tip therein.

An even further object of the invention is to provide a tip guard and a lock plate that are constructed of durable materials that resist wear when used to erode ground when directing pressurized water.

A further object of the invention is to provide a tip guard that includes a cavity that mirrors the exterior surface of the oscillating spray tip and which includes an opening aligned adjacent the spray tip so as to not obstruct the jet of high pressure water.

A further object of the invention is to provide a securing means and lock plate that when installed on an oscillating spray tip shall not become disassembled with respect to the oscillating spray tip.

These together with additional objects, features and advantages of the oscillating pressurized spray tip protection assembly will be readily apparent to those of ordinary skill in the art upon reading the following detailed description of presently preferred, but nonetheless illustrative, embodiments of the oscillating pressurized spray tip protection assembly when taken in conjunction with the accompanying drawings.

In this respect, before explaining the current embodiments of the oscillating pressurized spray tip protection assembly in detail, it is to be understood that the oscillating pressurized spray tip protection assembly is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the oscillating pressurized spray tip protection assembly.

It is therefore important that the claims be regarded as including such equivalent construction insofar as they do not depart from the spirit and scope of the oscillating pressurized spray tip protection assembly. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 1 illustrates a perspective view of the oscillating pressurized spray tip protection assembly by itself and detailing the tip guard, lock plate, and securing means exploded there from;

DETAILED DESCRIPTION OF THE EMBODIMENT

Figure 1:
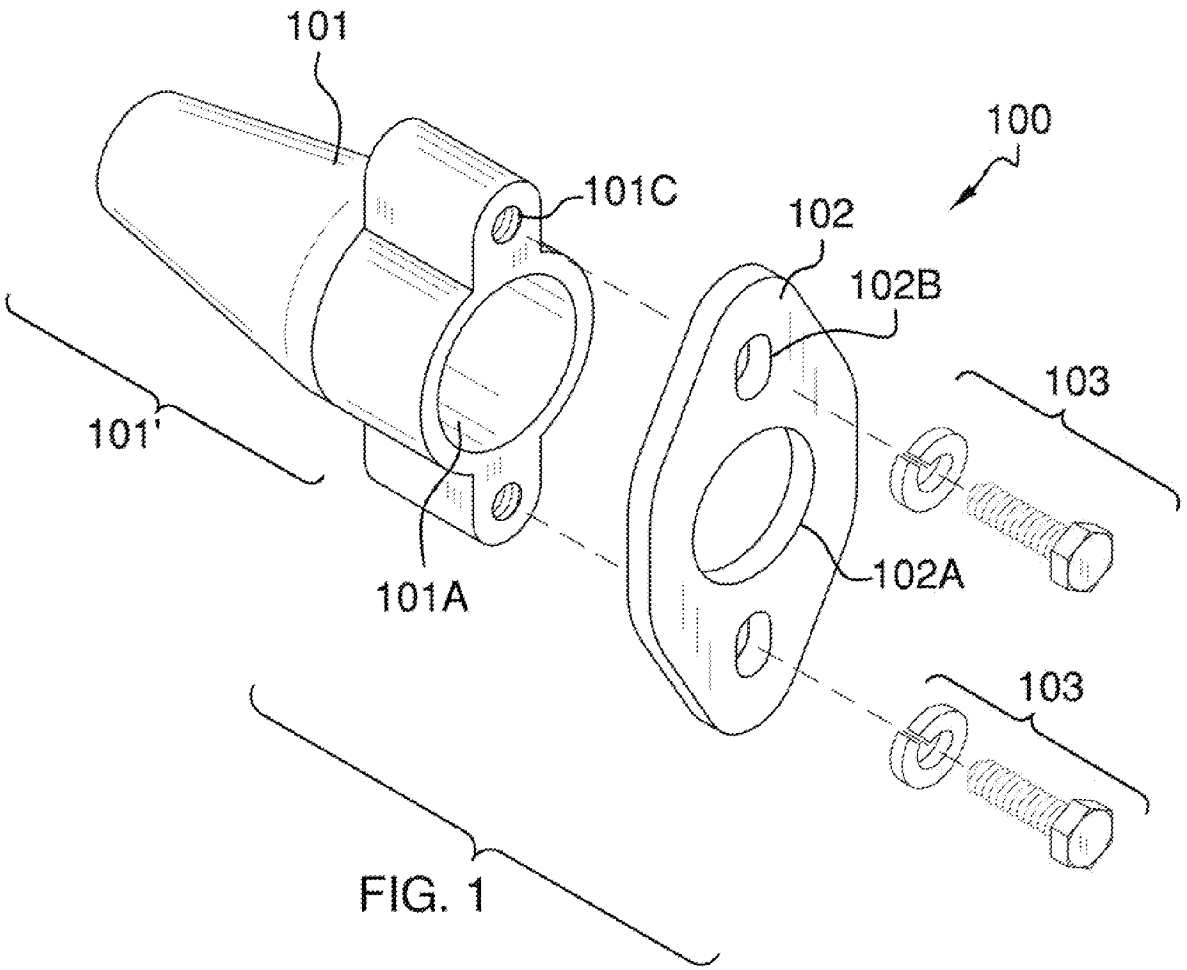

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. An oscillating pressurized spray tip protection assembly 100 (hereinafter invention) includes a tip guard 101 and a lock plate 102. The tip guard 101 is composed of a cavity 101A that contours an exterior surface 130A of an oscillating spray tip 130. The cavity 101A is in fluid communication with an opening 101B that when installed on the oscillating spray tip 130 shall align adjacent an output of high-pressure water 140 exiting the oscillating spray tip 130.

The tip guard 101 also includes mounting means 101C, which work in conjunction with the lock plate 102 and securing means 103 to install the invention 100 upon the oscillating spray tip 130 and a high-pressure wand 131. The tip guard 101 may include a generally concave profile 101' that extends from the mounting means 101C to the opening 101B. It shall be further noted that the opening 101B is located on an end of the tip guard 101 that is opposite the mounting means 101C.

More specifically, the mounting means 101C are located more adjacent the lock plate 102. The lock plate 102 is defined by a high-pressure wand hole 102A and mounting mean holes 102B that are located on opposing sides of the high-pressure wand hole 102A. The high-pressure wand hole 102A is aligned adjacent the cavity 101A of the tip guard 101 when assembled (see FIG. 3); whereas the mounting mean holes 102B are aligned adjacent the mounting means 101C of the tip guard 101.

The mounting means 101C of the tip guard 101 include at least one threaded hole through which the securing means 103 may attach and secure the lock plate 102 with respect to the invention 100. In referring to FIG. 4, the securing means 103 encapsulates the oscillating spray tip 130 within and between the tip guard 101 and the lock plate 102.

The securing means 103 are comprised of at least one bolt and locking washer that secure the lock plate 102 to the tip guard 101 when installed with the oscillating spray tip 130 located therein. It shall be noted that when installing the invention 100, the lock plate 102 shall be first threaded through the high-pressure wand 131, and thereafter connection of the oscillating spray tip 130 to the high-pressure wand 131. Next, the tip guard 101 is placed over the oscillating spray tip 130, and the securing means 103 are installed and tightened in order to secure the assembly of the invention 100 around the oscillating spray tip 130.

Figure 3:
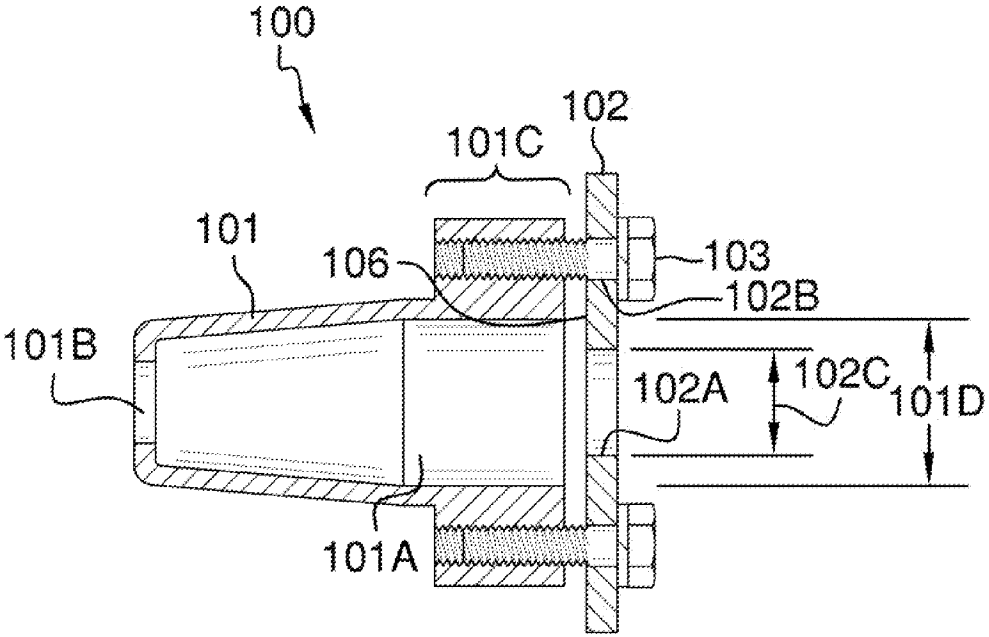
FIG. 3 illustrates a cross-sectional view of the oscillating pressurized spray tip protection assembly along line 3-3 in FIG. 2, and detailing the securing means connecting together the lock plate and the tip guard.
Figure 2:
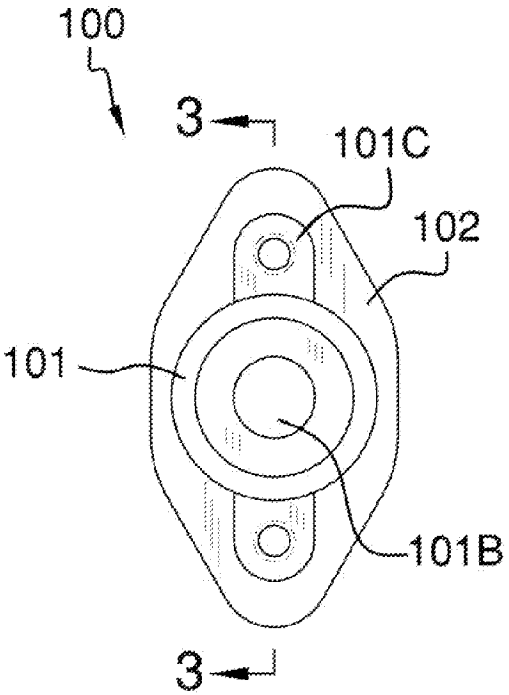
FIG. 2 illustrates a top view of the tip guard and lock plate secured to one another.
Figure 3A:
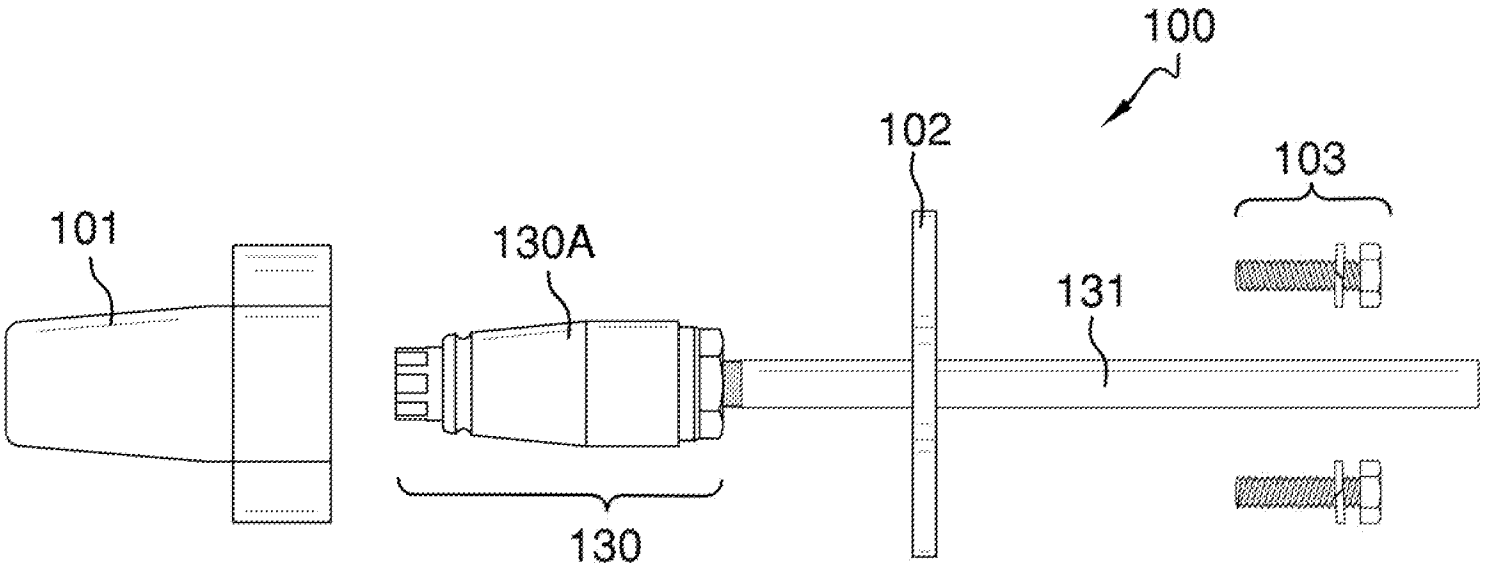
FIG. 3A illustrates a side view of the oscillating pressurized spray tip protection assembly exploded with the oscillating spray tip and high pressure wand attached to one another and inserted through the lock plate

Referring to FIG. 3, the high-pressure wand hole 102A of the lock plate 102 has a diameter 102C, which is less than a diameter 101D of the cavity 101A such that a shoulder 106 is formed there between. The shoulder 106 is responsible for securing the oscillating spray tip 130 within the invention 100 when so assembled.

Figure 4:
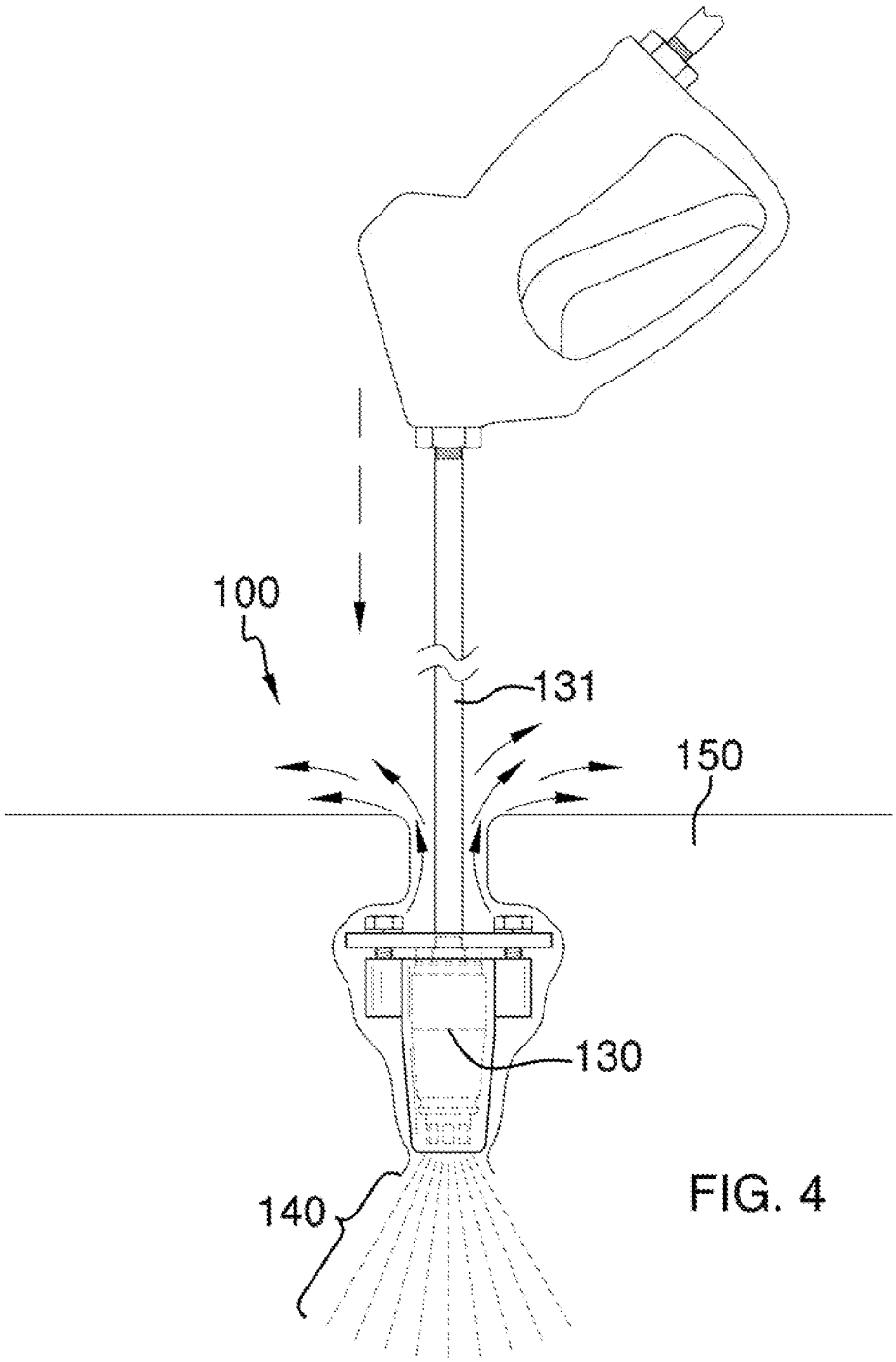
FIG. 4 illustrates a side view of the oscillating pressurized spray tip protection assembly in use with an oscillating spray tip connected to a high pressure wand, and which has been inserted into the ground in order to depict the "potholing" procedure used to erode the ground adjacent the high pressure jet of water.

Referring to FIG. 4, the invention 100 is used to direct the high-pressure water 140 into ground 150, which is eroded and then washed aside of the invention 100 and the oscillating spray tip 130/high-pressure wand 131. The entire assembly of the invention 100, the oscillating spray tip 130 and the high-pressure wand 131 are directed downward as the ground 150 is essentially eroded and washed upward by the force of the high-pressure water 140.

The tip guard 101 and the lock plate 102 shall be made of a material comprising a metal or carbon fiber composite. Moreover, the invention 100 shall be made of a metal comprising a stainless steel, a tool grade steel, a titanium alloy, or a high strength aluminum.

Figure 5:
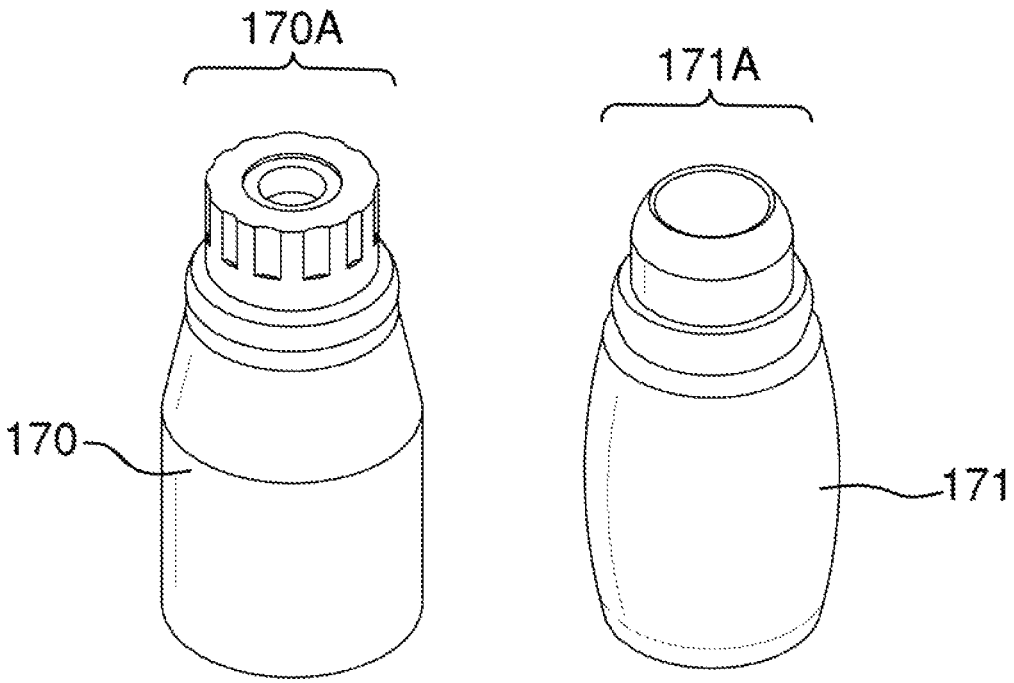
FIG. 5 illustrates a comparison of two oscillating spray tips in which a first spray tip exhibits wearing from repeated use in potholing and a second spray tip is free from wear when used in potholing for a same amount of use.

In referring to FIG. 5, two oscillating spray tips 130 are placed together for comparison. A first oscillating spray tip 170 includes a spray tip end 170A that is in good working condition; whereas a second oscillating spray tip 171 includes a spray tip end 171A that has been completely worn out, and is no longer useful. It shall be noted that the first oscillating spray tip 170 has been used for an identical period of time and for the same purpose as the second oscillating spray tip 171. Moreover, the first oscillating spray tip 170 has been used with the invention 100 while the second oscillating strap tip 171 has not.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An oscillating pressurized spray tip protection assembly comprising:

a tip guard and lock plate secured together around and enclosing an oscillating spray tip thereby protecting and prolonging the useful life of said oscillating spray tip from wear when used to penetrate ground via pressurized water;

wherein the tip guard includes a cavity in fluid communication with an opening, which when said oscillating spray tip is inserted shall not obstruct the pressurized water exiting the oscillating spray tip;

wherein the tip guard and the lock plate secure together via securing means;

wherein the tip guard includes mounting means for use with the securing means;

wherein the lock plate includes a high-pressure wand hole centered and at least one mounting means hole;

wherein the securing means is comprised of a bolt and locking washer; wherein the mounting means of the tip guard is comprised of at least one threaded hole.

2. The oscillating pressurized spray tip protection assembly as described in claim 1 wherein the cavity contours an exterior surface of said oscillating spray tip.

3. The oscillating pressurized spray tip protection assembly as described in claim 1 wherein the high-pressure wand hole is aligned adjacent the cavity of the tip guard when assembled; whereas the mounting mean holes are aligned adjacent the mounting means of the tip guard.

4. The oscillating pressurized spray tip protection assembly as described in claim 1 wherein the high-pressure wand hole of the locking plate is less than a diameter of the cavity thereby forming a shoulder, which secures the oscillating spray tip within.

5. The oscillating pressurized spray tip protection assembly as described in claim 1 wherein the tip guard and locking plate are made of a material comprising a metal or a carbon fiber composite.

6. An oscillating pressurized spray tip protection assembly comprising:

a tip guard and lock plate secured together around and enclosing an oscillating spray tip thereby protecting and prolonging the useful life of said oscillating spray tip from wear when used to penetrate ground via pressurized water;

wherein the tip guard includes a cavity in fluid communication with an opening, which when said oscillating spray tip is inserted shall not obstruct the pressurized water exiting the oscillating spray tip;

wherein the cavity contours an exterior surface of said oscillating spray tip;

wherein the tip guard and the lock plate secure together via securing means;

wherein the tip guard includes mounting means for use with the securing means;

wherein the tip guard includes a generally concave profile that extends from the mounting means to the opening;

wherein the lock plate includes a high-pressure wand hole centered and at least one mounting means hole;

wherein the securing means is comprised of a bolt and locking washer; wherein the mounting means of the tip guard is comprised of at least one threaded hole;

wherein the high-pressure wand hole is aligned adjacent the cavity of the tip guard when assembled; whereas the mounting mean holes are aligned adjacent the mounting means of the tip guard;

wherein the high-pressure wand hole of the locking plate is less than a diameter of the cavity thereby forming a shoulder, which secures the oscillating spray tip within.

7. The oscillating pressurized spray tip protection assembly as described in claim 6 wherein the tip guard and locking plate are made of a material comprising a metal or a carbon fiber composite.

* * * * *